United States Patent [19]

Havriluk

[11] Patent Number: 4,654,010

[45] Date of Patent: Mar. 31, 1987

[54] METHOD AND APPARATUS OF MEASURING SWIMMING TECHNIQUE

[76] Inventor: Rod Havriluk, 2110 W. Randolph Cir., Tallahasse, Fla. 32312

[21] Appl. No.: 707,518

[22] Filed: Mar. 4, 1985

[51] Int. Cl.[4] ..... A63B 69/12

[52] U.S. Cl. ..... 434/254; 73/753; 272/71; 310/337; 455/100

[58] Field of Search ..... 364/558; 272/71, 116; 310/319, 337, 338; 340/626, 870.16; 455/100; 73/753, 754; 434/254

[56] References Cited

U.S. PATENT DOCUMENTS

| | | | |
|---|---|---|---|
| 3,806,131 | 4/1974 | Evans | 273/186 A |
| 4,160,234 | 7/1979 | Karbo et al. | 310/338 |
| 4,218,056 | 8/1980 | Whitling | 272/71 |
| 4,422,634 | 12/1983 | Hopkins | 272/71 |

FOREIGN PATENT DOCUMENTS

| | | | |
|---|---|---|---|
| 0731980 | 5/1980 | U.S.S.R. | 434/254 |
| 0943810 | 7/1982 | U.S.S.R. | 272/71 |
| 1105206 | 7/1984 | U.S.S.R. | 272/71 |

*Primary Examiner*—Leo P. Picard

*Attorney, Agent, or Firm*—McGlew and Tuttle

[57] ABSTRACT

A method and device for measuring swimming technique utilizes a pressure transducer mounted to the hand of a swimmer. A measurement is taken of the pressure differential between the palm and the back of the swimmer's hand is measured during swimming and is plotted against time with the help of a microcomputer. An area under this curve is calculated and gives a measurement of the swimming effectiveness.

7 Claims, 3 Drawing Figures

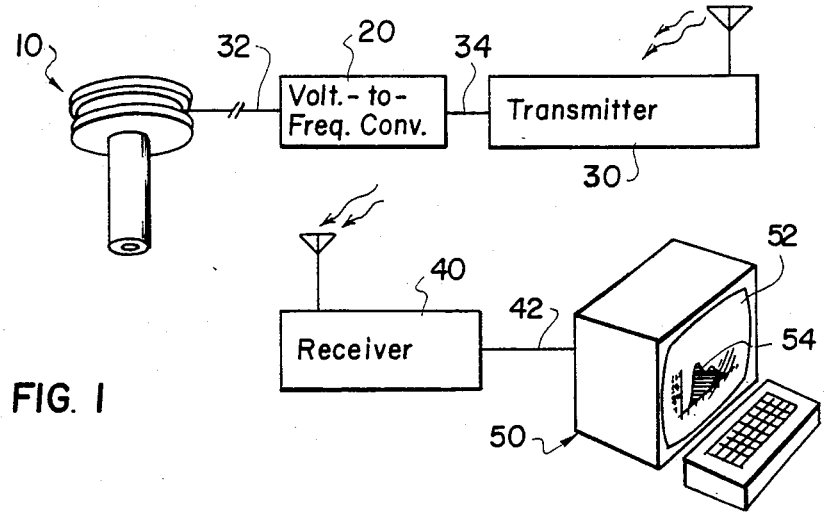
FIG. 1
FIG. 2
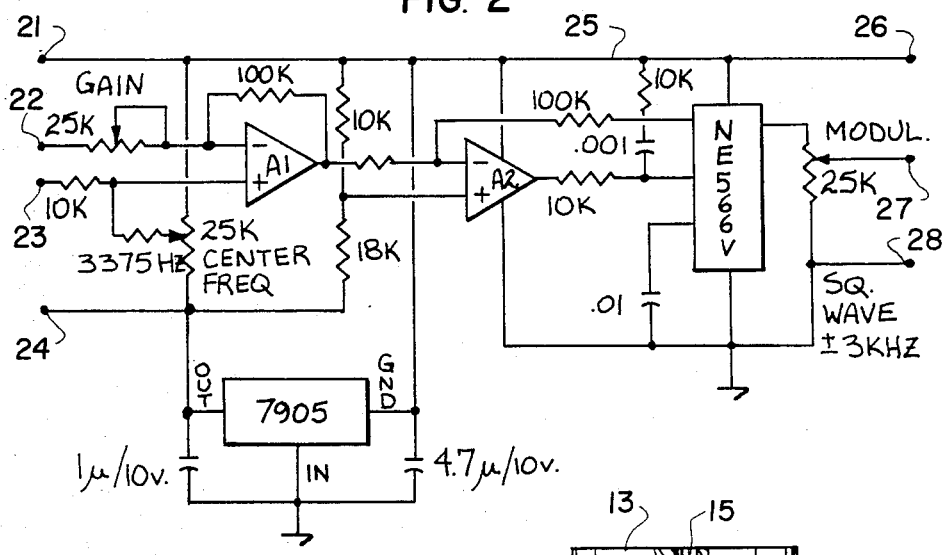
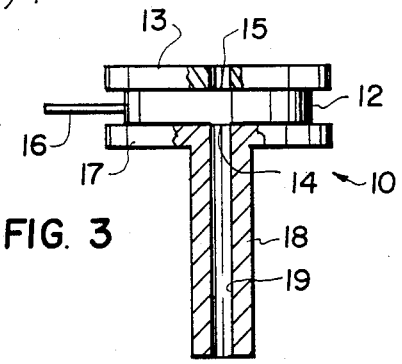
FIG. 3

METHOD AND APPARATUS OF MEASURING SWIMMING TECHNIQUE

FIELD AND BACKGROUND OF THE INVENTION

The present invention relates in general to measuring schemes and, in particular to a new and useful method and apparatus of measuring the efficiency and effectiveness of a swimmer's technique.

U.S. Pat. No. 4,218,056 to Whittling discloses the use of a transducer and a meter for measuring pressure exerted by a swimmer during a swimming stroke. Whittling does not utilize a transducer connected to the hand of a swimmer for measuring the pressure differential between the palm and the back of the swimmer's hand during swimming nor does it plot a curve of this pressure differential over time to determine the overall swimming effectiveness or efficiency.

U.S. Pat. No. 4,422,634 to Hopkins utilizes a computer in a swimming simulator to measure force exerted during a swimming stroke. Here again, however, the overall effectiveness of this swimming technique is not measured.

Other patents which are relevant and utilize the measurement of force applied during a swimming stroke are U.S. Pat. No. 2,825,224 to Lindenauer et al, U.S. Pat. No. 3,140,550 to Wayfield and U.S. Pat. No. 4,095,657 to Hogwart.

SUMMARY OF THE INVENTION

The present invention is drawn to an apparatus and method for measuring swimming technique which utilize a pressure transducer that measures a differential in pressure between the palm and the back of a swimmer's hand, and transmits a signal representing this pressure to a mechanism which is capable of plotting a curve of pressure vs. time. A calculation is made to determine the area under the curve, which area is directly related to the swimming technique or efficiency.

Accordingly, an object of the present invention is to provide a method of measuring swimming technique which includes measurement of a pressure differential between the palm and the back of a swimmer's hand during swimming and over a period of time, plotting a curve of this pressure against time and measuring the area under this curve.

A further object of the invention is to provide a device for measuring swimming technique which includes a pressure transducer to be worn on the hand or another part of the swimmer's body, a transmitter for transmitting a signal corresponding to the pressure exerted on the transducer, a receiver for receiving the signal and calculation means, preferably in the form of a personal computer for plotting the curve of pressure over time and calculating the area under that curve.

A further object of the invention is to provide a device for measuring swimming technique which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a diagrammatical illustration showing a device used in accordance with the invention;

FIG. 2 is a schematic representation of a voltage-to-frequency converter used to convert a voltage signal from the transducer to a frequency signal for the transmitter; and FIG. 3 is a side elevational view, partially in section, of a pressure transducer to be used in accordance with the invention.

DESCRIPTION OF THE PREFERRED EMBODIMENT

Referring to the drawings in particular, the invention embodied in FIG. 1 comprises a device for measuring swimming technique. The device includes a pressure transducer assembly generally designated 10 which generates a voltage that varies with pressure exerted on a transducer in the assembly. The transducer assembly 10 is connected to a voltage-to-frequency converter 20 which receives the varying voltage on line 32 and generates a varying freqency which corresponds to the varying voltage on line 34.

A transmitter 30 is connected to line 34 which transmits the varying frequency to a receiver 40. Receiver 40 provides the varying frequency on a line 42 which is connected to a computer generally designated 50.

Transducer assembly 10 as best shown in FIG. 3, comprises a pressure transducer 12 which has two apertures or pressure ports 14 and 15 which are responsive to a pressure differential.

A so-called "differential X-ducer silicon pressure sensor element" can be utilized as transducer 12 which is manufactured by the Motorola Company and identified as Model No. MPX 50D. This transducer has four leads shown correctively at 16 which are color coded green, red, yellow and black. The black acts as a ground connection, the yellow acts as a plus output, the green acts as a voltage supply input and the red acts as a negative output. The connection of these leads will be described in greater detail later with regard to FIG. 2.

In FIG. 3, transducer assembly 10 is shown to include an aluminum tube or hollow shaft 18 which contains a bore 19 that communicates the ambient at the palm of the hand with the positive pressure port 14. Tube or shaft 18 includes a flange 17 which is screwed or otherwise fastened to a washer 13 with transducer 12 between the flange and the washer. Negative port 15 communicates with the ambient on the back of the hand.

Transducer assembly 10 is meant to be secured between the middle and ring finger of a swimmer with the open end of bore 19 facing outwardly of the palm. Transducer 12 is thus disposed on the back of the hand over the middle and ring fingers. The middle and ring fingers can be taped together for positively holding the transducer to the hand. Other fastening mechanisms may be utilized however.

A wire connects leads 16 to the voltage-to-frequency converter 20 and connected transmitter 20. The wire leads down the back of the hand and arm of the swimmer, and over the back of the swimmer to the converter plus transmitter assembly mounted in the small of the swimmer's back at his or her waist. The transmitter and converter may be held there by a belt around the swimmer's waist or by a clip fastened to the swimsuit.

It will be understood that during swimming, a pressure differenttial will be established between the palm and the back of the swimmer's hand and this pressure differential will be converted into a voltage signal by transducer assembly 10. While the transducer assembly is best mounted to the hand of the swimmer, it can be mounted elsewhere on the swimmer's body where different characteristics of the swimming technique are to be measured.

FIG. 2 shows an exemplary voltage-to-frequency converter which is connected between the leads 16 of transducer 12 and the leads of a transmitter 30 (shown in FIG. 1).

The respective green, red, yellow and black leads of transducer 12 are connected to input terminals 21, 22, 23 and 24 of the circuit of FIG. 2. Line 25 of the circuit is connected to a nine volt regulator and acts as a power supply. The red lead connected to terminal 22 is applied to a gain potentiometer shown at the negative input of a first differential amplifier A1. Approximately 6.5 volts are applied to terminal 22. Approximately 6.5 volts are also applied to the yellow lead of the transducer at terminal 23 and is connected over a resistor and frequency selector to the positive terminal of amplifier A1.

The integrated circuit 7905 is a voltage regulator which is readily available. It is noted that the input of this voltage regulator labeled "IN" is connected to a common terminal which is not a ground but which receives a plus or minus 5 kHz peak to peak squarewave. This same squarewave is connected to the input of an integrated circuit identified as NE566V which is a known and available voltage controlled oscillator.

A second differential amplifier A2 is connected to the output of amplifier A1 and itself has an output connected to another input of the voltage controlled oscillator. Output terminal 26 of the circuit of FIG. 2 is connected to a voltage regulator (not shown). Terminals 27 and 28 are connected to transmitter 30 with terminal 28 being the common terminal which receives the squarewave.

Transmitter 30 is of the FM on FM type and receives the modulated audio frequency from terminal 27 which changes a varicap diode that is tuned to a crystal. Receiver 40 receives the FM signal. A "ten-ten" model made by Federal Sign and Signal Corporation can be used as receiver 40. The output of the receiver on line 42 is a varying frequency which can be measured by computer 50.

A Commodore 64 microcomputer can be used as computer 50 which can receive the varying frequency signal. Software has been developed by the inventor for plotting the signal against time which is shown on monitor 52. The programming includes a calculating section for calculating the area under a curve 54.

The signal corresponds to the pressure differential so that the area under curve 54 represents swimming efficiency or technique.

While a specific embodiment of the invention has been shown and described in detail to illustrate the application of the principles of the invention, it will be understood that the invention may be embodied otherwise without departing from such principles.

What is claimed is:

1. A method of measuring swimming technique during actual swimming comprising:

measuring a pressure differential between the palm and the back of a swimmer's hand during actual swimming, over a period of time transmitting said pressure differential in the form of radio waves to a remotely located receiver;

plotting a curve of the pressure differential over the time period; and calculating an area under the curve as a measurement of swimming technique.

2. A method according to claim 1 including generating a signal corresponding to the pressure differential at the swimmer's hand, transmitting the signal from the swimmer to a receiver spaced from the swimmer and utilizing computer means connected to the receiver for plotting the curve and calculating the area under the curve.

3. A method according to claim 2, including utilizing a pressure transducer at the swimmer's hand which generates a voltage which varies with the pressure differential, converting the varying voltage to a varying frequency and transmitting the varying frequency over the transmitter to the receiver.

4. A device for measuring swimming technique during actual swimming comprising:

a pressure transducer means adapted to be worn by a swimmer during swimming, said pressure transducer means generating a signal corresponding to a pressure differential exerted on a part of the swimmer's body;

a radio transmitter connected to said transducer for transmitting said signal;

a radio receiver disposed at a spaced location with respect to said transmitter for receiving said transmitted signal; and calculator means connected to said receiver for plotting a curve of said signal over time and for calculating an area under said curve.

5. A device according to claim 4, wherein said transducer generates a voltage signal which varies with pressure, said device including a voltage-to-frequency converter connected between said transducer and said transmitter for converting said varying voltage to a varying frequency, said transmitter adapted to transmit said varying frequency to said receiver.

6. A device according to claim 5, wherein said calculator means comprises a microcomputer.

7. A device according to claim 5, wherein said transducer includes pressure ports, said device including a hollow shaft connected to said transducer for conveying water pressure to one of said ports, said shaft shaped to engage between two adjacent fingers of the swimmer with an open end of said hollow shaft facing in the same direction as a palm of the swimmer's hand.

* * * * *